US009377001B2

(12) United States Patent
Aochi et al.

(10) Patent No.: US 9,377,001 B2
(45) Date of Patent: Jun. 28, 2016

(54) SPARK PLUG FOR INTERNAL COMBUSTION ENGINE

(71) Applicants: NIPPON SOKEN, INC., Nishio, Aichi-pref. (JP); DENSO CORPORATION, Kariya, Aichi-pref. (JP)

(72) Inventors: Takanobu Aochi, Nishio (JP); Kaori Doi, Kariya (JP); Masamichi Shibata, Toyota (JP); Noriaki Nishio, Ichinomiya (JP)

(73) Assignees: DENSO CORPORATION, Kariya (JP); NIPPON SOKEN, INC., Nishio (JP)

( * ) Notice: Subject to any disclaimer, the term of this patent is extended or adjusted under 35 U.S.C. 154(b) by 0 days.

(21) Appl. No.: 14/718,453

(22) Filed: May 21, 2015

(65) Prior Publication Data

US 2015/0337791 A1 Nov. 26, 2015

(30) Foreign Application Priority Data

May 22, 2014 (JP) ..... 2014-106282

(51) Int. Cl.
*H01T 13/02* (2006.01)
*F02P 15/00* (2006.01)

(52) U.S. Cl.
CPC ..... *F02P 15/001* (2013.01); *H01T 13/02* (2013.01)

(58) Field of Classification Search
USPC ..... 123/169 EL
See application file for complete search history.

(56) References Cited

U.S. PATENT DOCUMENTS 4,851,732 A * 7/1989 Kashiwara ..... H01T 13/32 123/169 EL

FOREIGN PATENT DOCUMENTS

JP 09-148045 6/1997
JP 2014-116181 6/2014

* cited by examiner

*Primary Examiner* — Ashok Patel
(74) *Attorney, Agent, or Firm* — Nixon & Vanderhye P.C.

(57) ABSTRACT

A spark plug has a housing, a pair of center and ground electrodes configured to define a spark gap therebetween, a guide member and an oblique surface. The ground electrode has a standing portion that stands distalward from a distal end of the housing. The guide member is configured to guide the flow of an air-fuel mixture in a combustion chamber of an engine to the spark gap. The guide member protrudes distalward from the distal end of the housing at a different circumferential position from the ground electrode. The oblique surface is formed at the distal end of the housing so as to be circumferentially positioned between the guide member and the standing portion of the ground electrode. The oblique surface is oblique to the axial direction of the spark plug so that the radial distance between the oblique surface and the center electrode decreases in the distalward direction.

4 Claims, 10 Drawing Sheets

SPARK PLUG FOR INTERNAL COMBUSTION ENGINE

CROSS-REFERENCE TO RELATED APPLICATION

This application is based on and claims priority from Japanese Patent Application No. 2014-106282 filed on May 22, 2014, the content of which is hereby incorporated by reference in its entirety into this application.

BACKGROUND

1. Technical Field

The present invention relates to spark plugs for internal combustion engines.

2. Description of the Related Art

As ignition means in internal combustion engines, such as engines of motor vehicles, there are used spark plugs which have a spark gap formed between a center electrode and a ground electrode that are axially opposed to each other. Those spark plugs discharge a spark across the spark gap, thereby igniting an air-fuel mixture in a combustion chamber.

In the combustion chamber, there is formed a flow of the air-fuel mixture, such as a swirl flow or tumble flow. With the flow of the air-fuel mixture moderately flowing also in the spark gap, it is possible to ensure the ignition capability of the spark ping (i.e., the capability of the spark plug to ignite the air-fuel mixture).

However, depending on the mounting posture (or mounting state) of the spark plug to the internal combustion engine, part of the ground electrode, which is joined to a distal end of a housing of the spark plug, may be located upstream of the spark gap with respect to the flow of the air-fuel mixture. In this case, the flow of the air-fuel mixture in the combustion chamber may be blocked by the ground electrode, thereby being stagnated in the vicinity of the spark gap. As a result, the ignition capability of the spark plug may be lowered. That is, the ignition capability of the spark plug may vary depending on the mounting posture of the spark plug to the internal combustion engine. In particular, in lean-burn internal combustion engines which have been widely used in recent years, the combustion stability may be lowered depending on the mounting posture of the spark plug.

However, it is generally difficult to control the mounting posture of a spark plug to an internal combustion engine, i.e., difficult to control the circumferential position of the ground electrode of the spark plug relative to the internal combustion engine. This is because the mounting posture of the spark plug to the internal combustion engine varies depending on the state of formation of a male-threaded portion in the housing of the spark plug and the degree of fastening the male-threaded portion into a female-threaded bore formed in the engine.

To solve the above problem, Japanese Patent Application Publication No. JPH09148045A discloses two techniques for preventing the flow of the air-fuel mixture from being blocked by the ground electrode. The first technique is to form a slot-like hole in the ground electrode. The second technique is to fix the ground electrode to the housing through a plurality of thin plate-shaped members.

However, in the case of applying the first technique, the strength of the ground electrode may be lowered due to the formation of the slot-like hole in the ground electrode. Moreover, if the ground electrode was formed to have a large thickness for ensuring the strength thereof, it would become easier for the ground electrode to impede the flow of the air-fuel mixture in the combustion chamber.

On the other hand, in the case of applying the second technique, the shape of the ground electrode is complicated, thus increasing the manufacturing cost and lowering the productivity.

SUMMARY

According to exemplary embodiments, there is provided a spark plug for an internal combustion engine. The spark plug has a tubular housing, a tubular insulator, a center electrode, a ground electrode, a guide member and an oblique surface. The insulator is retained in the housing. The center electrode is secured in the insulator with a distal end portion of the center electrode protruding outside the insulator. The ground electrode is configured to define a spark gap between the center and ground electrodes in an axial direction of the spark plug. The ground electrode has a standing portion that stands distalward from a distal end of the housing. The guide member is configured to guide the flow of an air-fuel mixture in a combustion chamber of the internal combustion engine to the spark gap. The guide member protrudes distalward from the distal end of the housing at a different circumferential position from the ground electrode. The oblique surface is formed at the distal end of the housing so as to be positioned in a circumferential direction of the spark plug between the guide member and the standing portion of the ground electrode. The oblique surface is oblique to the axial direction of the spark plug so that the radial distance between the oblique surface and the center electrode decreases in the distalward direction.

The above spark plug has the following advantages.

First, with the guide member, it is possible to guide the flow of the air-fuel mixture in the combustion chamber of the engine to the spark gap regardless of the mounting posture of the spark plug to the engine.

More specifically, even when the standing portion of the ground electrode is located upstream of the spark gap with respect to the flow of the air-fuel mixture in the combustion chamber, it is still possible to guide the flow of the air-fuel mixture passing by the standing portion of the ground electrode to the spark gap by the guide member. Consequently, it is possible to suppress stagnation of the flow of the air-fuel mixture in the vicinity of the spark gap. As a result, it is possible to secure a stable ignition capability of the spark plug.

Moreover, with the oblique surface, it is possible to effectively stabilize the ignition capability of the spark plug.

More specifically, the flow of the air-fuel mixture in the combustion chamber is not always in a direction perpendicular to the axial direction of the spark plug. Instead, the flow of the air-fuel mixture may have a vector component toward the proximal side in the axial direction of the spark plug. In this case, without the oblique surface, a spark discharged across the spark gap would be blown toward the housing by the flow of the air-fuel mixture flowing into the spark gap. Consequently, the flame might be cooled by the housing, thereby resulting in a misfire. In particular, the flow of the air-fuel mixture passing through a circumferential gap between the guide member and the standing portion of the ground electrode is apt to be accelerated by the guidance of the guide member. If the accelerated flow of the air-fuel mixture has a vector component toward the proximal side, it would be particularly easy for the spark to be blown by the flow of the air-fuel mixture to the housing and thereby cause a misfire to occur.

However, in the above-described spark plug, with the oblique surface, it is possible to alter to the distal side the direction of the flow of the air-fuel mixture passing through the circumferential gap. Consequently, even when the flow of the air-fuel mixture is inclined toward the proximal side at an angle of, for example, about 60° to the axial direction of the spark plug, it is still possible to alter the flow into a flow in the spark gap which has a considerably smaller vector component toward the proximal side or has a vector component toward the distal side. As a result, it is possible to reliably prevent a misfire from occurring, thereby ensuring the ignition capability of the spark plug.

To sum up, the above-described spark plug can secure, with a simple configuration, a stable ignition capability regardless of the mounting posture of the spark plug to the engine.

In a further implementation, the oblique surface may be formed to extend in the circumferential direction of the spark plug only within an angular range of less than or equal to 90° between the guide member and the standing portion of the ground electrode. Moreover, in this case, it is preferable that the oblique surface is formed to extend in the circumferential direction of the spark plug over the entire angular range.

BRIEF DESCRIPTION OF THE DRAWINGS

The present invention will be understood more fully from the detailed description given hereinafter and from the accompanying drawings of exemplary embodiments, which, however, should not be taken to limit invention to the specific embodiments but are for the purpose of explanation and understanding only.

In the accompanying drawings.

DESCRIPTION OF EMBODIMENTS

Figure 1:
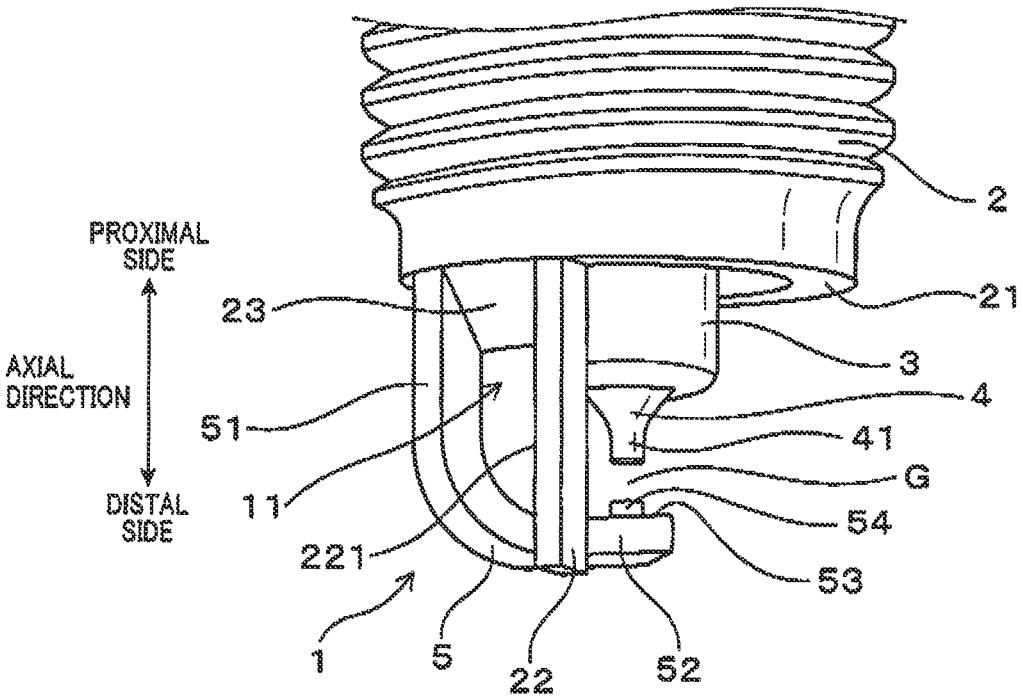
FIG. 1 is a perspective view of a distal part of a spark plug according to a first embodiment.

Exemplary embodiments will be described hereinafter with reference to FIGS. 1-18. It should be noted that for the sake of clarity and understanding, identical components having identical functions throughout the whole description have been marked, where possible, with the same reference numerals in each of the figures and that for the sake of avoiding redundancy, descriptions of the identical components will not be repeated.

First Embodiment

This embodiment illustrates a spark plug 1 that is designed to be used as ignition means in an internal combustion engine of for example, a motor vehicle.

More specifically, the spark plug 1 is designed to ignite an air-fuel mixture in a combustion chamber of the engine. The spark plug 1 has one axial end to be connected to an ignition coil not shown) and the other axial end to be placed inside the combustion chamber. In addition, hereinafter, as shown in FIG. 1, the axial side where the spark plug 1 is to be connected to the ignition coil will be referred to as "proximal side"; and the other axial side where the spark plug 1 is to be placed inside the combustion chamber will be referred to as "distal side".

As shown in FIGS. 1-4, the spark plug 1 according to the present embodiment includes: a tubular housing (or metal shell) 2; a tubular insulator 3 retained in the housing 2; a center electrode 4 secured in the insulator 3 such that a distal end portion 41 of the center electrode 4 protrudes outside the insulator 3; and a ground electrode 5 configured to protrude distalward (i.e., toward the distal side) from a distal end 21 of the housing 2 and define a spark gap G between the center and ground electrodes 4 and 5 in the axial direction of the spark plug 1.

Specifically, in the present embodiment, the ground electrode 5 is substantially L-shaped to have a standing portion 51 and an opposing portion 52. The standing portion 51 is provided to stand (or protrude) distalward from the distal end 21 of the housing 2. The opposing portion 52 extends perpendicular to the standing portion 51 and has an opposing surface 53 that opposes the distal end portion 41 of the center electrode 4 in the axial direction of the spark plug 1 through the spark gap G formed therebetween.

Moreover, the spark plug 1 according to the present embodiment further includes a guide member 22 for guiding the flow of the air-fuel mixture hi the combustion chamber of the engine to the spark gap G. The guide member 22 protrudes distalward from the distal end 21 of the housing 2 at a different circumferential position front the standing portion 51 of the ground electrode 5. The guide member 22 has a flat guide surface 221 that faces the ground electrode 5 in the circumferential direction of the spark plug 1.

Furthermore, in the present embodiment, at the distal end 21 of the housing 2, there is formed an oblique surface 23 which is oblique to the axial direction of the spark plug 1 such that the oblique surface 23 is directed radially inward as it extends distalward. In other words, the oblique surface 23 is oblique to the axial direction of the spark plug 1 so that the radial distance between the oblique surface 23 and the center electrode 3 decreases in the distalward direction. Moreover, the oblique surface 23 is circumferentially positioned between the guide member 22 and the standing portion 51 of the ground electrode 5.

In other words, the oblique surface 23 is positioned within a circumferential gap (or a flow-passing gap through which the flow of the air-fuel mixture passes) 11 formed between the guide member 22 and the standing portion 51 of the ground electrode 5. The angular range of the circumferential gap 11 is less than or equal to 90°. That is, the expression "the oblique surface 23 is circumferentially positioned between the guide member 22 and the standing portion 51 of the ground electrode 5" used hereinafter denotes that the oblique surface 23 is circumferentially positioned within the angular range of less than or equal to 90° (i.e., not the angular range of greater than or equal to 90°) between the guide member 22 and the standing portion 51 of the ground electrode 5.

In the present embodiment, the oblique surface 23 is formed only within the angular range of less than or equal to 90° (or within the flow-passing gap 11) between the guide member 22 and the standing portion 51 of the ground electrode 5.

Moreover, in the present embodiment, the oblique surface 23 is formed over the entire angular range of less than or equal to 90° between the guide member 22 and the standing portion 51 of the ground electrode 5.

Figure 4:
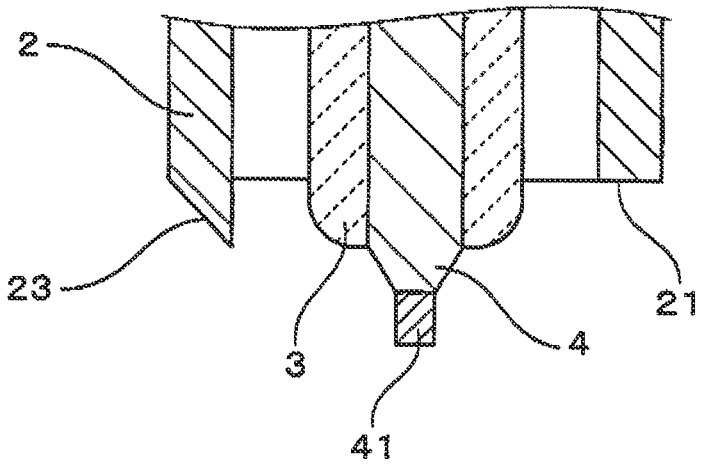
FIG. 4 is a cross-sectional view taken along the line IV-IV in FIG. 3.

Furthermore, in the present embodiment, as shown in FIG. 4, the oblique surface 23 is formed over substantially the entire radial thickness of the housing 2.

Figure 5:
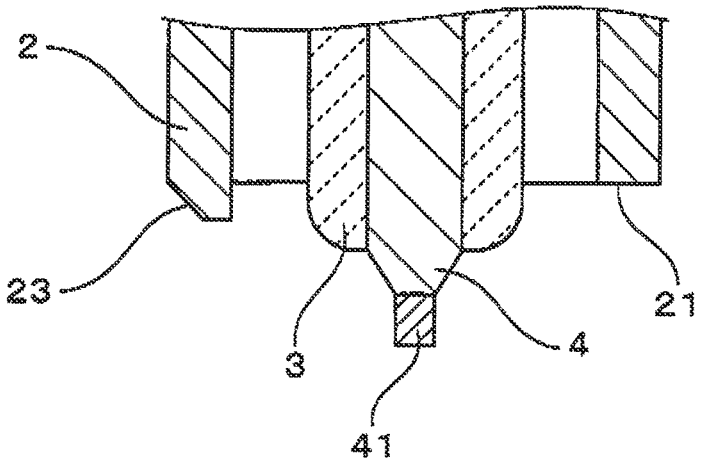
FIG. 5 is a cross-sectional view illustrating a modification of the shape of an oblique surface formed in the spark plug according to the first embodiment.

However, it should be appreciated that the oblique surface 23 may be formed over only part of the radial thickness of the housing 2, as shown in FIG. 5.

The oblique surface 23 may be oblique at an angle in the range of, for example, 30 to 70° to the axial direction of the spark plug 1. In other words, the oblique angle of the oblique surface 23 to the axial direction of the spark plug 1 may be in the range of for example, 30 to 70°.

In the present embodiment, the oblique surface 23 is formed as a taper surface such that on a plane that includes a central axis of the spark plug 1 (i.e., on the paper surface of FIG. 4), the oblique surface 23 is in the shape of a straight line.

However, it should be appreciated that the oblique surface 23 may be formed as a curved surface such that on the plane that includes the central axis of the spark plug 1, the oblique surface 23 is in the shape of a curved line.

In the present embodiment, the oblique surface 23 has its distal end positioned proximalward from the distal end portion 41 of the center electrode 4. Moreover, the distal end of the oblique surface 23 protrudes distalward from the distal end 21 of the housing 2 by, for example, 0.7 mm or more.

Figure 2:
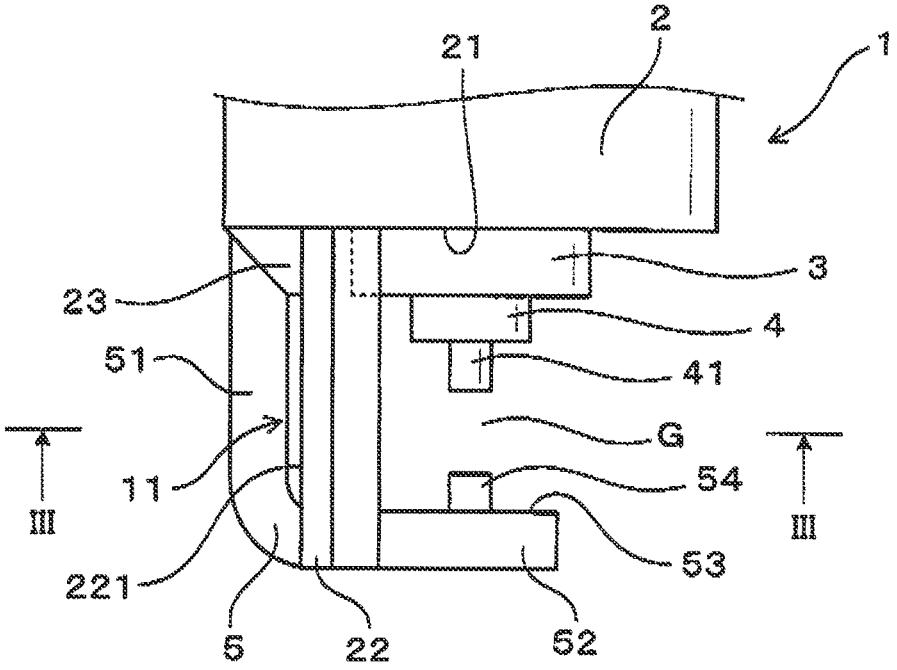
FIG. 2 is a side view of the distal part of the spark plug.

In the present embodiment, as shown in FIGS. 1-2, the ground electrode 5 has a protrusion 54 provided on the opposing surface 53 of the opposing portion 52. The spark gap G is formed between the distal end portion 41 of the center electrode 4 and the protrusion 54 of the ground electrode 5. In addition, the distal end portion 41 of the center electrode 4 and the protrusion 54 of the ground electrode 5 are each constituted by a noble metal chip.

Figure 3:
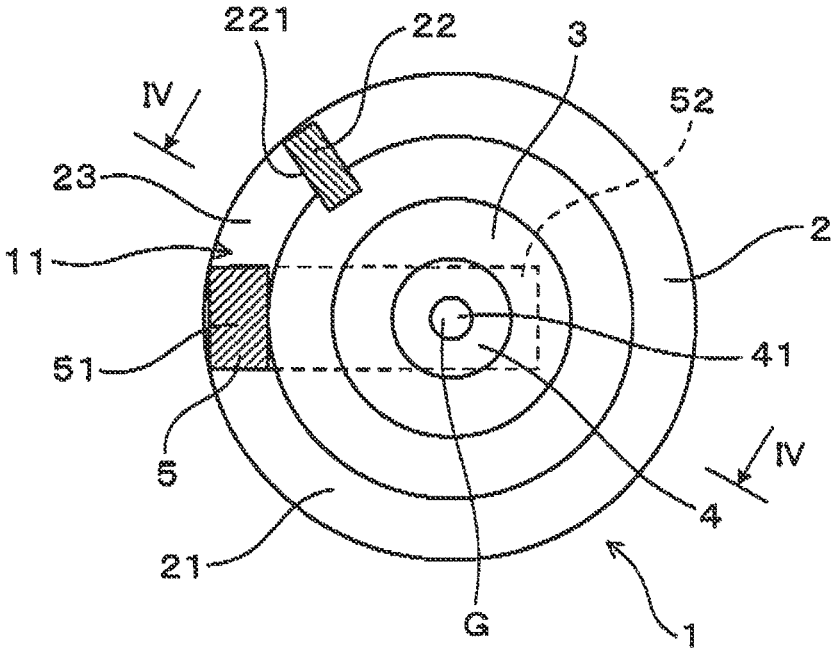
FIG. 3 is a cross-sectional view taken along the line III-III in FIG. 2.

In the present embodiment, as shown in FIGS. 1-3, the guide member 22 has the shape of a quadrangular prism and is arranged to extend from the distal end 21 of the housing 2 distalward in the axial direction of the spark plug 1. The guide member 22 has its distal end positioned distalward from the spark gap G. Moreover, the guide member 22 has its radial width greater than its circumferential width. Further, the circumferential width of the guide member 22 is less than the circumferential width of the standing portion 51 of the ground electrode 5. In addition, that one of the two circumferential side faces of the guide member 22 which circumferentially faces the standing portion 51 of the ground electrode 5 constitutes the guide surface 221 of the guide member 22.

Next, a method of manufacturing the spark plug 1 according to the present embodiment will be described. This method includes first to eighth steps.

Figure 8:
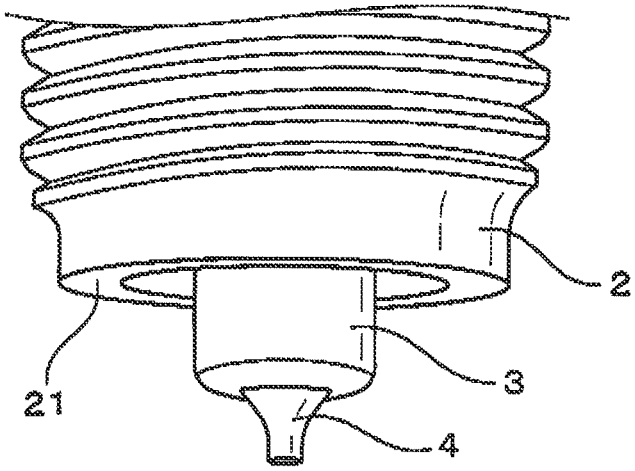
FIG. 8 is a schematic view illustrating the first step of a method of manufacturing the spark plug according to the first embodiment.

In the first step, as shown in FIG. 8, the housing 2 is prepared which has both the insulator 3 and the center electrode 4 assembled therein.

Figure 9:
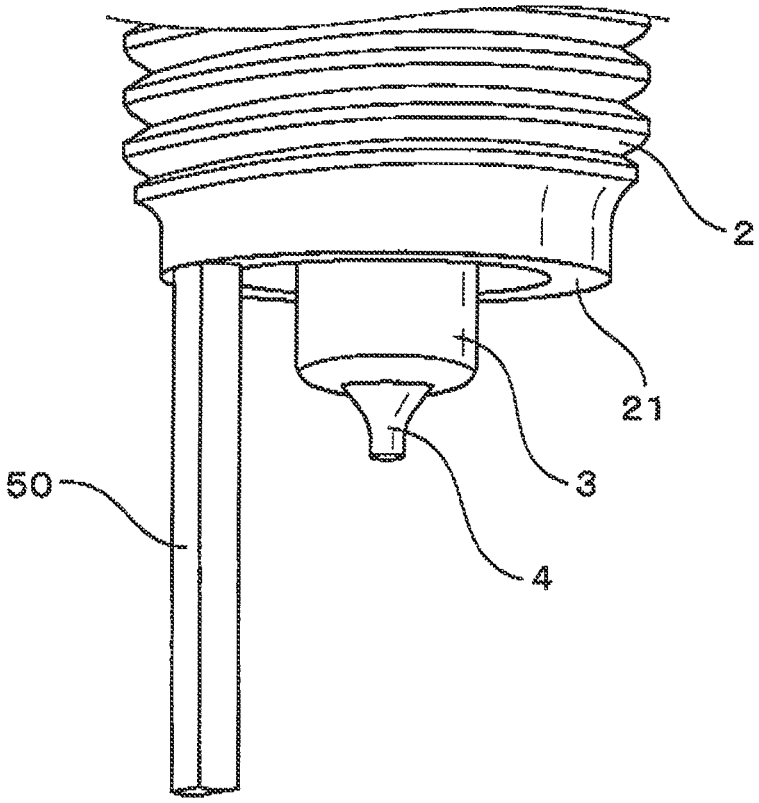
FIG. 9 is a schematic view illustrating the second step of the method of manufacturing the spark plug.

In the second step, as shown in FIG. 9, a quadrangular prism-shaped electrode material 50 for forming the ground electrode 5 is welded, for example by resistance welding, to the distal end 21 of the housing 2.

In addition, in this step, though not shown in FIG. 9 and subsequent FIGS. 10-14, the noble metal chip for forming the protrusion 54 of the ground electrode 5 is welded to a predetermined area on a side face of the electrode material 50.

Figure 10:
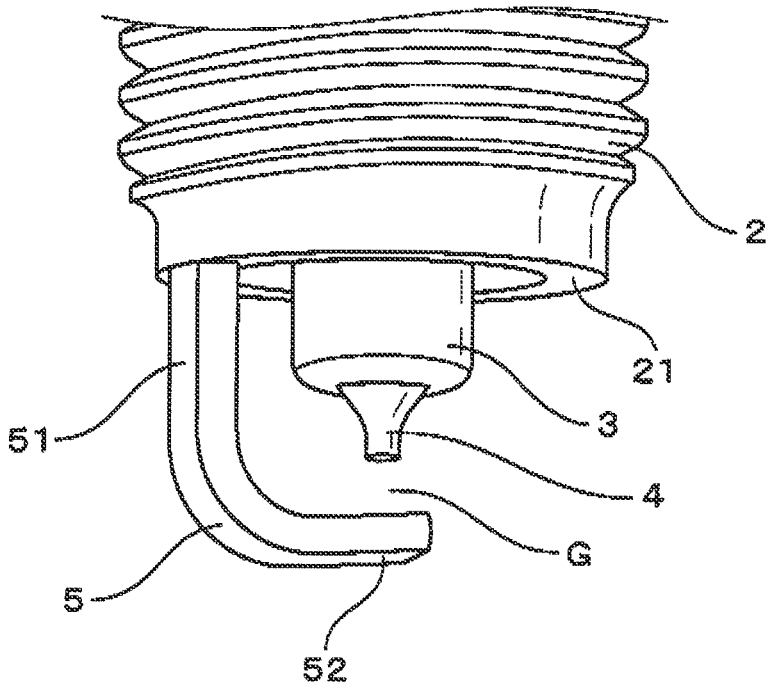
FIG. 10 is a schematic view illustrating the third step of the method of manufacturing the spark plug.

In the third step, as shown in FIG. 10, the electrode material 50 is bent to form the substantially L-shaped ground electrode 5. Consequently, the spark gap G is formed between the center electrode 4 and the ground electrode 5.

Figure 11:
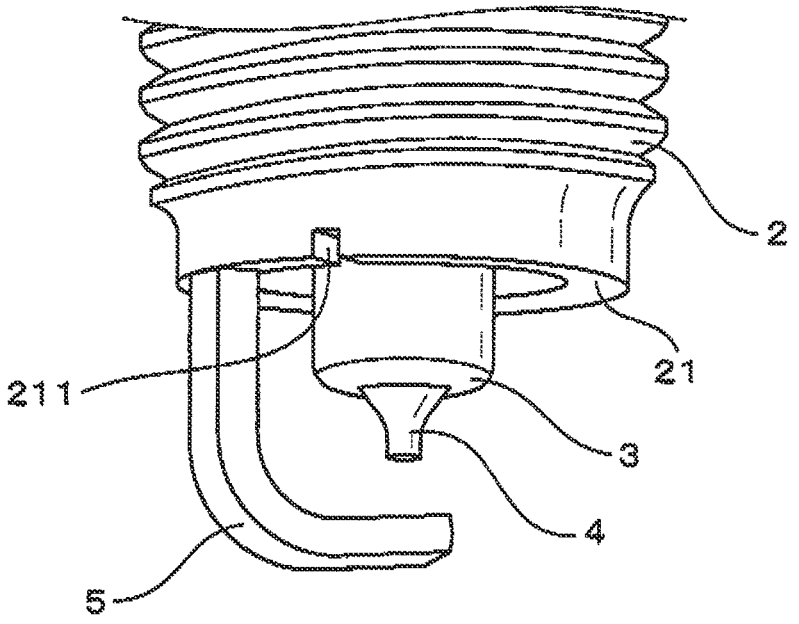
FIG. 11 is a schematic view illustrating the fourth step of the method of manufacturing the spark plug.

In the fourth step, as shown in FIG. 11, at a predetermined position on the distal end 21 of the housing 2, a groove 211 is formed so as to penetrate the housing 2 in a radial direction of the spark plug 1. In addition, the position of formation of the groove 211 is predetermined based on the positional relationship between the center electrode 4, the ground electrode 5 and the guide member 22 which will be fitted in the groove 211 in the next step.

Figure 12:
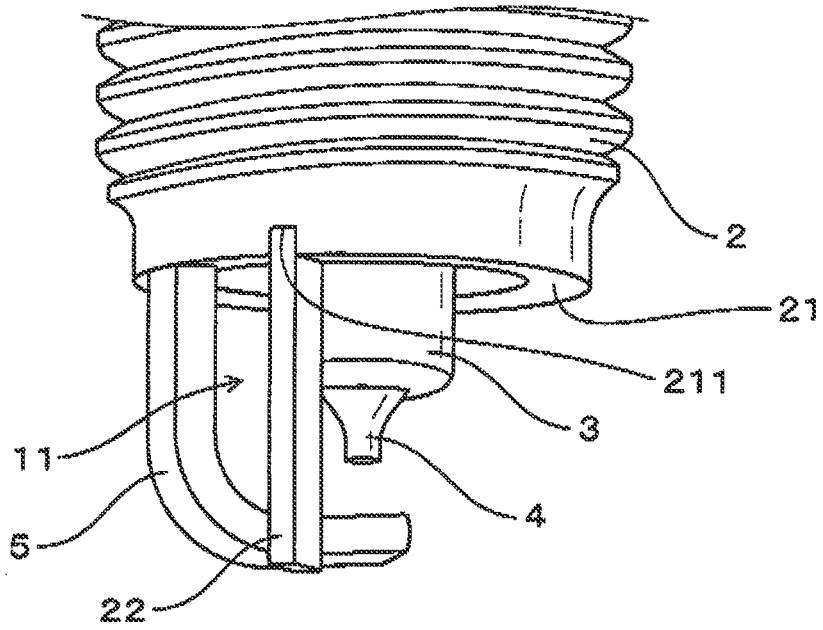
FIG. 12 is a schematic view illustrating the fifth step of the method of manufacturing the spark plug.

In the fifth step, as shown in FIG. 12, a proximal end portion of the guide member 22 is fitted in the groove 211.

Figure 13:
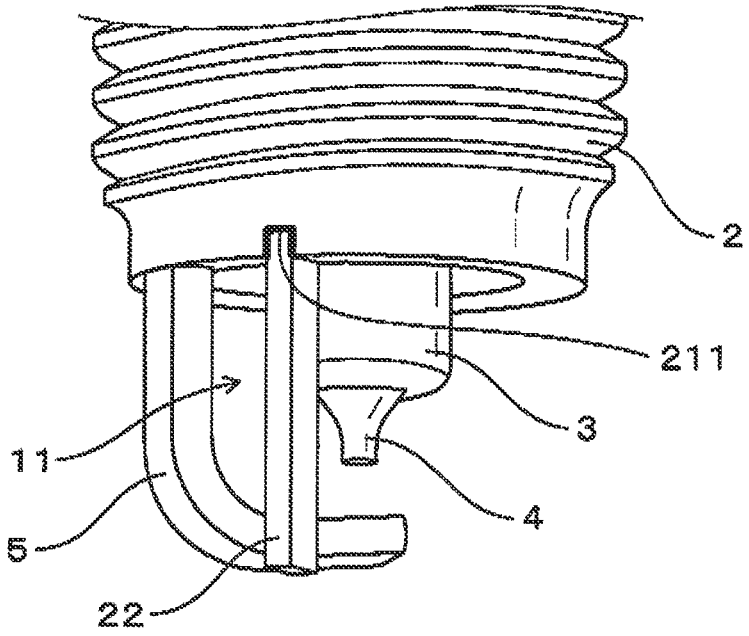
FIG. 13 is a schematic view illustrating the sixth step of the method of manufacturing the spark plug.

In the sixth step, as shown in FIG. 13, the proximal end portion of the guide member 22 is welded, for example by resistance welding, to peripheral portions of the groove 211 in the housing 2.

Figure 14:
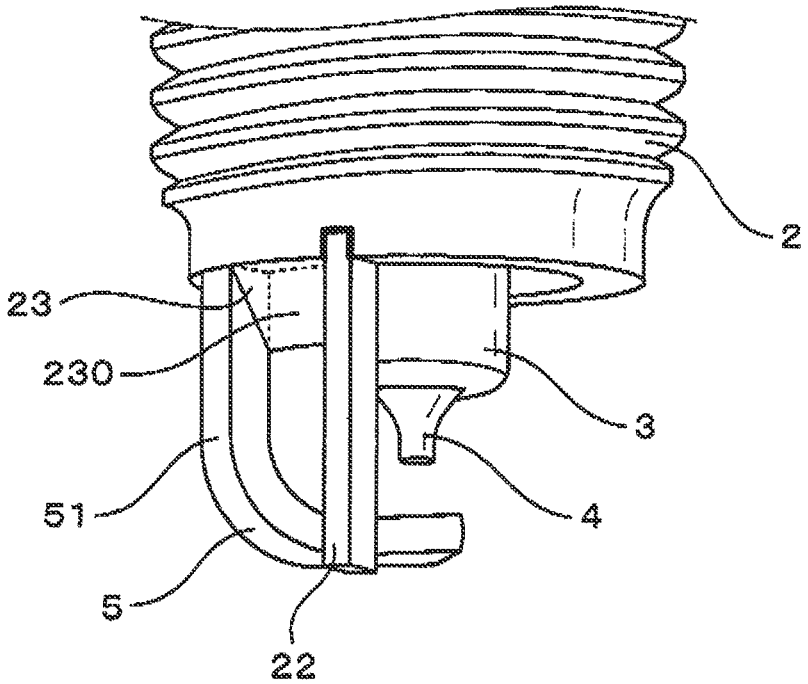
FIG. 14 is a schematic view illustrating the seventh and eighth steps of the method of manufacturing the spark plug.

In the seventh step, a shown in FIG. 14, an oblique surface-forming member 230 is arranged between the guide member 22 and the standing portion 51 of the ground electrode 5 on the distal end 21 of the housing 2.

In addition, the oblique surface-forming member 230 may be made of the same material as the housing 2, the ground electrode 5 and the guide member 22, such as a nickel alloy.

In the eighth step, referring again to FIG. 14, the oblique surface-forming member 230 is welded, for example by resistance welding, to the distal end 21 of the housing 2, thereby forming the oblique surface 23. As a result, the spark plug 1 is finally obtained.

In addition, in the eighth step, the oblique surface-forming member 230 may also be simultaneously welded to the standing portion 51 of the ground electrode 5 and the guide member 22.

It should be noted that laser welding may be used instead of resistance welding in the above second, sixth and eighth steps of the method.

The above-described spark plug 1 according to the present embodiment has the following advantages.

In the present embodiment, the spark plug 1 includes the guide member 22. Consequently, it is possible to guide the flow F of the air-fuel mixture in the combustion chamber of the engine to the spark gap G regardless of the mounting posture of the spark plug 1 to the engine.

Figure 7:
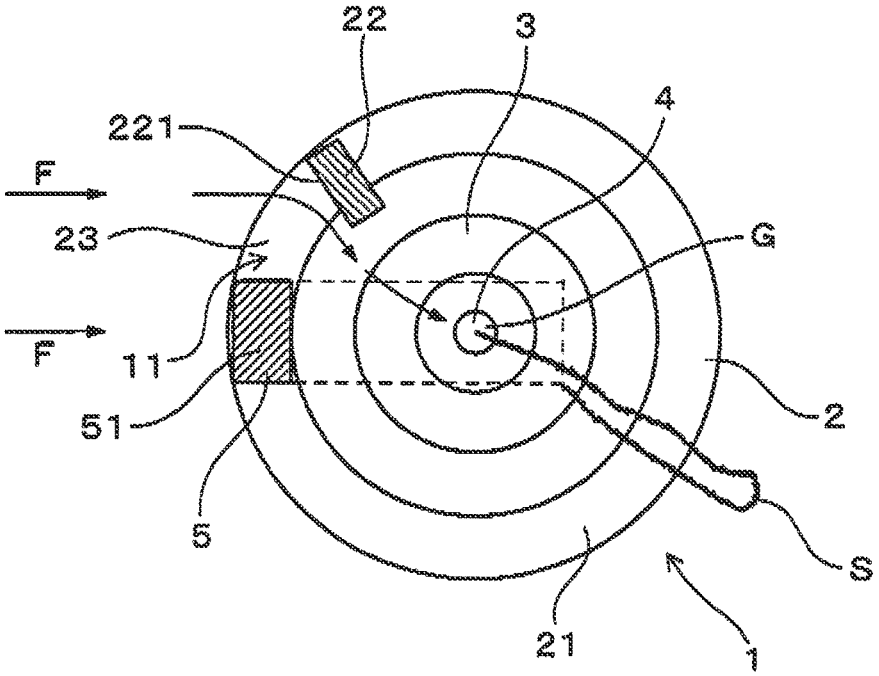
FIG. 7 is a Gross-sectional view taken along the line VII-VII in FIG. 6.

Specifically, as shown in FIG. 7, even when the standing portion 51 of the ground electrode 5 is located upstream of the spark gap G with respect to the flow F of the air-fuel mixture in the combustion chamber, it is still possible to guide the flow F of the air-fuel mixture passing by the standing portion 51 of the ground electrode 5 to the spark gap G by the guide member 22. Consequently, it is possible to suppress stagnation of the flow F of the air-fuel mixture in the vicinity of the spark gap G. As a result, it is possible to secure a stable ignition capability of the spark plug 1.

Moreover, in the present embodiment, the spark plug 1 further has the oblique surface 23 formed at the distal end 21 of the housing 2 so as to be positioned in the circumferential direction of the spark plug 1 between the guide member 22 and the standing portion 51 of the ground electrode 5. The oblique surface 23 is oblique to the axial direction of the spark plug 1 such that the oblique surface 23 is directed radially inward as it extends distalward (i.e., the radial distance between the oblique surface 23 and the center electrode 3 decreases in the distalward direction). Consequently, with the oblique surface 23, it is possible to effectively stabilize the ignition capability of the spark plug 1.

Figure 6:
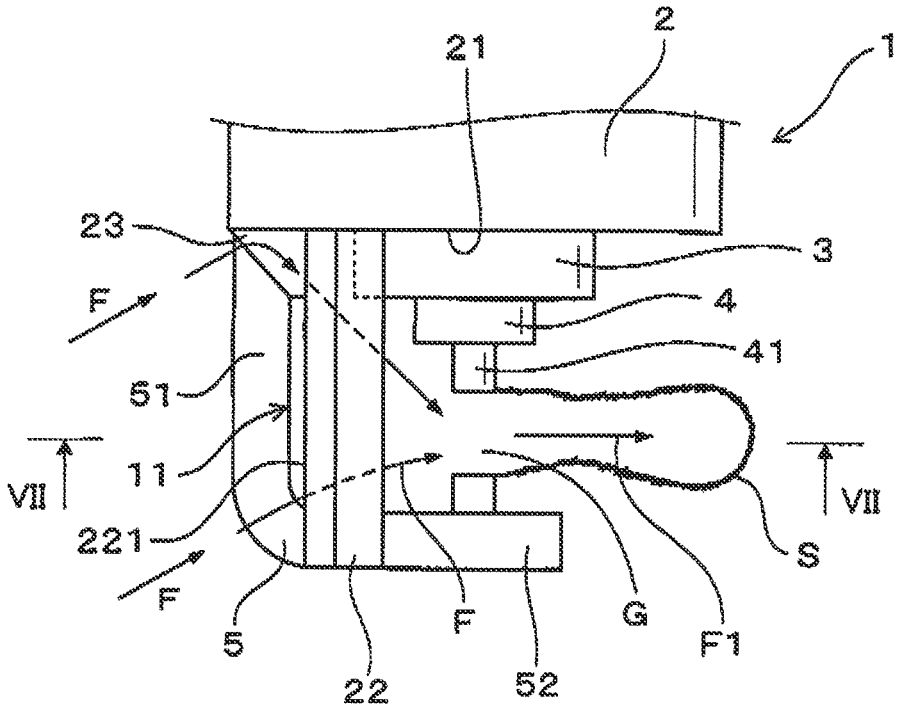
FIG. 6 is a schematic view illustrating advantages of the spark plug according to the first embodiment.

Specifically, the flow F of the air-fuel mixture flowing to the distal part of the spark plug 1 is not always in a direction perpendicular to the axial direction of the spark plug 1. Instead, as shown in FIG. 6, the flow F of the air-fuel mixture flowing to the distal part of the spark plug 1 may have a vector component toward the proximal side in the axial direction of the spark plug 1. In this case, without the oblique surface 23, a spark S discharged across the spark gap G would be blown toward the housing 2 by the flow F of the air-fuel mixture flowing into the spark gap G (see FIG. 16). Consequently, the flame might be cooled by the housing 2, thereby resulting in a misfire. In particular, the flow F of the air-fuel mixture passing through the circumferential gap 11 between the guide member 22 and the standing portion 51 of the ground electrode 5 is apt to be accelerated by the guidance of the guide member 22. If the accelerated flow F of the air-fuel mixture has a vector component toward the proximal side, it would be particularly easy for the spark S to be blown by the flow F to the housing 2 and thereby cause a misfire to occur.

However, in the present embodiment, as shown in FIG. 6, with the oblique surface 23, it is possible to alter to the distal side the direction of the flow F of the air-fuel mixture passing through the circumferential gap 11. Consequently, even when the flow F of the air-fuel mixture is inclined toward the proximal side at an angle of, for example, about 60° to the axial direction of the spark plug 1, it is still possible to alter the flow F into a flow F1 in the spark gap G; the flow F1 has a considerably smaller vector component toward the proximal side than the flow F or has a vector component toward the distal side. As a result, it is possible to reliably prevent a misfire from occurring, thereby ensuring the ignition capability of the spark plug 1.

Moreover, in the present embodiment, the oblique surface 23 is formed to extend in the circumferential direction of the spark plug 1 only within the angular range of the circumferential gap 11 (i.e., the angular range of less than or equal to 90° between the guide member 22 and the standing portion 51 of the ground electrode 5).

With the above formation of the oblique surface 23, it is possible to sufficiently secure the ignition capability of the spark plug 1.

Specifically, if the oblique surface 23 was formed outside the angular range of the circumferential gap 11 and the spark S was extended in length by the flow F of the air-fuel mixture flowing into the spark gap G via the circumferential gap 11, the spark S may reach the oblique surface 23 depending on the position of the oblique surface 23. In contrast, with the above formation of the oblique surface 23 according to the present embodiment, it is possible to prevent the above problem from occurring, thereby enhancing the ignition capability of the spark plug 1.

Furthermore, in the present embodiment, the oblique surface 23 is formed to extend in the circumferential direction of the spark plug 1 over the entire angular range of the circumferential gap 11.

With the above formation of the oblique surface 23, it is possible for the oblique surface 23 to more reliably fulfill the function of altering the direction of the flow F of the air-fuel mixture. Consequently, it is possible to more effectively stabilize the ignition capability of the spark plug 1.

To sum up, the spark plug 1 according to the present embodiment can secure, with a simple configuration, a stable ignition capability regardless of the mounting posture of the spark plug 1 to the engine.

Comparative Example

Figure 15:
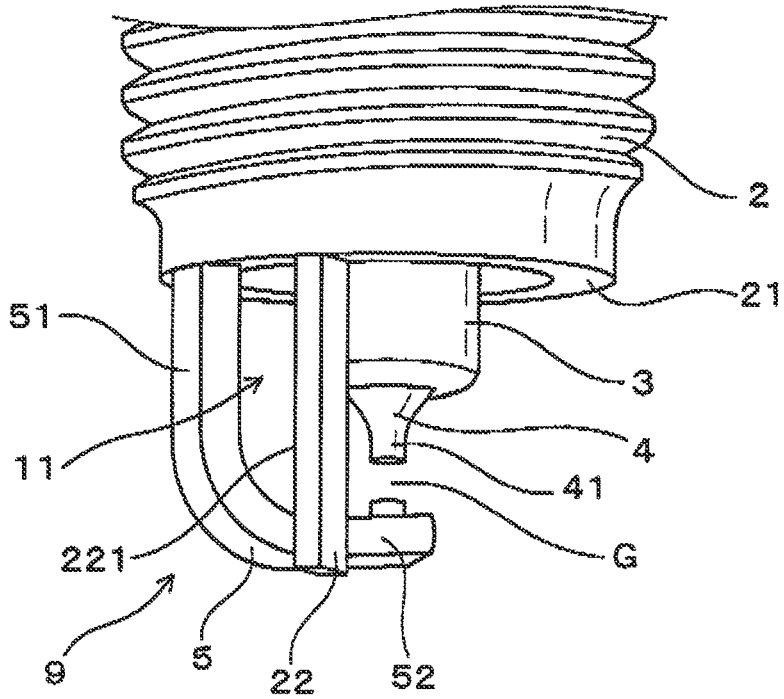
FIG. 15 is a perspective view of a distal part of a spark plug according to a comparative example.

FIG. 15 shows the overall configuration of a spark plug 9 according to a comparative example.

As shown in FIG. 15, the spark plug 9 differs from the spark plug 1 according to the first embodiment only in that unlike the spark plug 1, the spark plug 9 has no oblique surface 23 formed therein.

Figure 17:
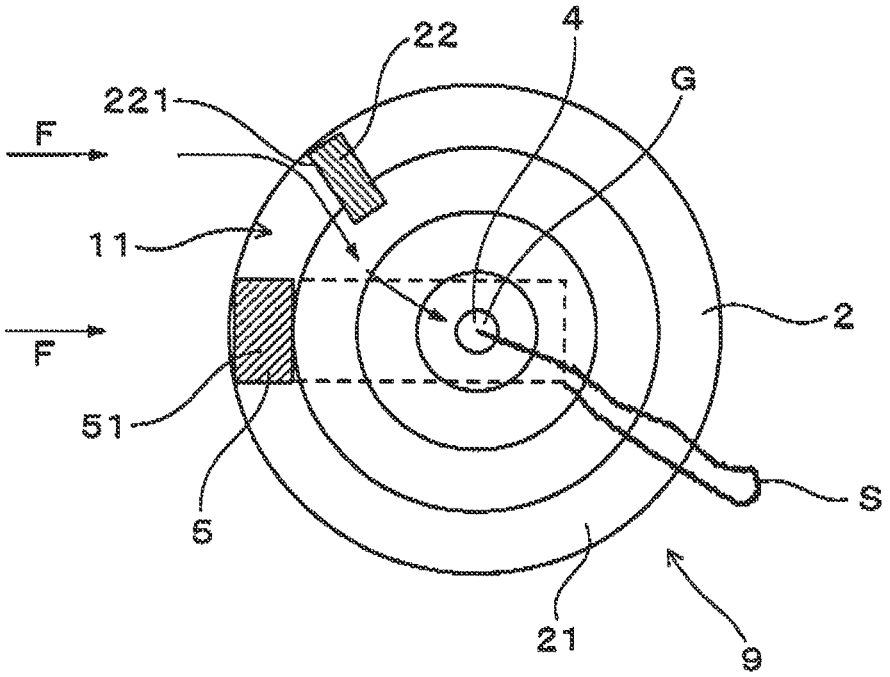
FIG. 17 is a cross-sectional view taken along the line XVII-XVII in FIG. 16.

As shown in FIG. 17, since the spark plug 9 also has the guide member 22, the flow F of the air-fuel mixture in the combustion chamber of the engine can be guided by the guide member 22 to the spark gap G formed in the spark plug 9 regardless of the mounting posture of the spark plug 9 to the engine.

However, without the oblique surface 23 described in the first embodiment, the ignition capability of the spark plug 9 may be lowered when the flow F of the air-fuel mixture has a vector component toward the proximal side in the axial direction of the spark plug 9.

Figure 16:
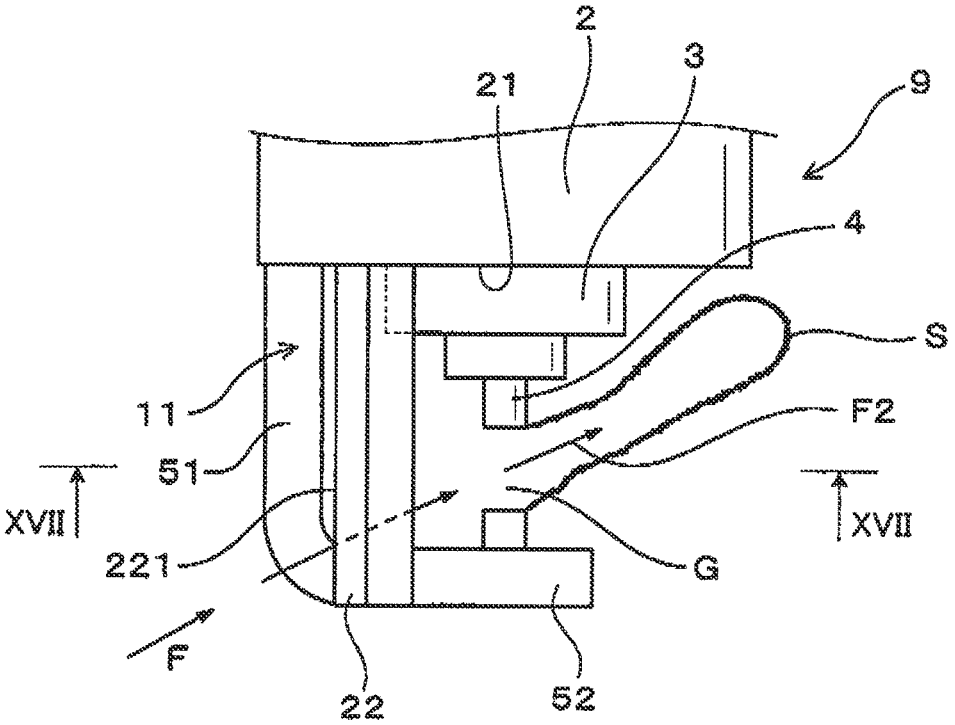
FIG. 16 is a side view of the distal part of the spark plug according to the comparative example, wherein a standing portion of a ground electrode is located upstream of a spark gap with respect to the flow of an air-fuel mixture in a combustion chamber.

Specifically, referring to FLU 16, assume that the standing portion 51 of the ground electrode 5 is located upstream of the spark gap G with respect to the flow F of the air-fuel mixture in the combustion chamber and the flow F of the air-fuel mixture has a vector component toward the proximal side. More particularly, assume that the flow F of the air-fuel mixture is inclined toward the proximal aide at an angle of, for example, about 60° to the axial direction of the spark plug 9. In this case, as shown in FIG. 17, part of the flow F of the air-fuel mixture passing by the standing portion 51 of the ground electrode 5 is guided (or altered in direction) by the guide surface 221 of the guide member 22 to the spark gap G. Consequently, the part of the flow F of the air-fuel mixture is accelerated when passing through the circumferential gap 11 between the guide member 22 and the standing portion 51 of the ground electrode 5. Moreover, as shown in FIG. 16, the flow F2 of the air-fuel mixture in the spark gap G is inclined toward the proximal side. Consequently, a spark S discharged across the spark gap G is blown toward the housing 2 by the flow F2 of the air-fuel mixture. As a result, the flame may be cooled by the housing 2, thereby resulting in a misfire.

Accordingly, without the oblique surface 23 described in the first embodiment, the ignition capability of the spark plug 9 may be lowered depending on the mounting posture of the spark plug 9 to the engine and on the condition of the flow F of the air-fuel mixture in the combustion chamber.

Second Embodiment

This embodiment illustrates a spark plug 1 which has almost the sane configuration as the spark plug 1 according to the first embodiment; accordingly, only the difference therebetween will be described hereinafter.

In the first embodiment, as described previously, the oblique surface 23 is formed to extend in the circumferential direction of the spark plug 1 only within the angular range of the circumferential gap 11 (see FIG. 1).

Figure 18:
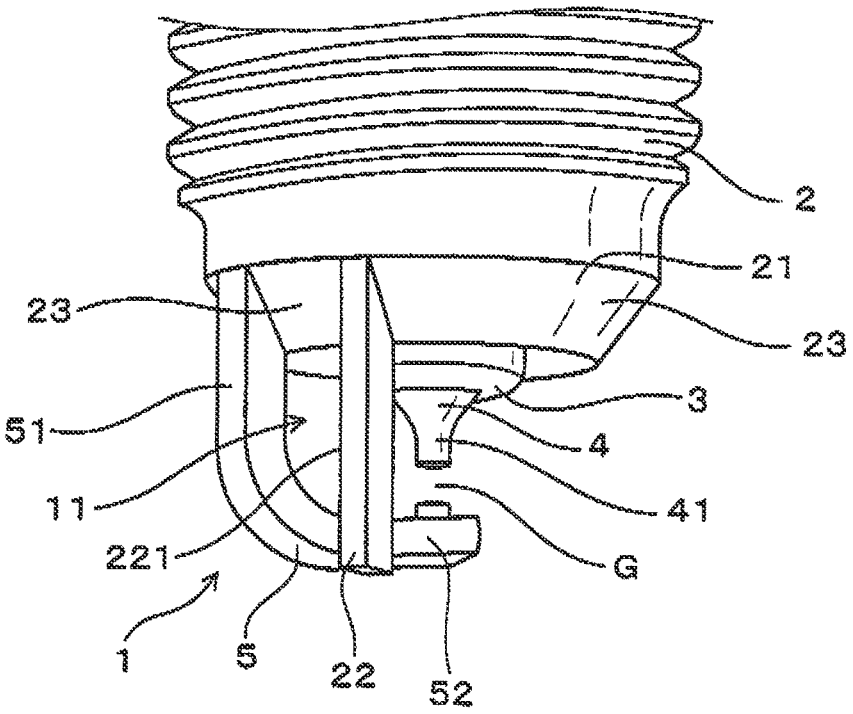
FIG. 18 is a perspective view of a distal part of a spark plug according to a second embodiment.

In comparison, in the present embodiment, as shown in FIG. 18, the oblique surface 23 is formed over the entire circumference of the distal end 21 of the housing 2. That is, the oblique surface 23 is formed at the distal end 21 of the housing 2 so as to extend in the circumferential direction of the spark plug 1 not only within the angular range of the circumferential gap 11 but also outside the angular range of the circumferential gap 11.

With the above configuration, it is possible to easily form the oblique surface 23, thereby facilitating the manufacture of the spark plug 1.

While the above particular embodiments have been shown and described, it will be understood by those skilled in the art that various modifications, changes, and improvements may be made without departing from the spirit of the present invention.

For example, in the above-described first embodiment, the spark plug 1 has only the single guide member 22 formed on one circumferential side of the standing portion 51 of the ground electrode 5 and only the single oblique surface 23 formed between the guide member 22 and the standing portion 51 of the ground electrode 5.

However, the spark plug 1 may be modified to have a pair of guide members 22 formed respectively on opposite circumferential sides of the standing portion 51 of the ground electrode 5 and a pair of oblique surfaces 23 each of which is formed between a corresponding one of the guide members 22 and the standing portion 51 of the ground electrode 5.

What is claimed is:

1. A spark plug for an internal combustion engine, the spark plug comprising:

a tubular housing:

a tubular insulator retained in the housing;

a center electrode secured in the insulator with a distal end portion of the center electrode protruding outside the insulator;

a ground electrode configured to define a spark gap between the center and ground electrodes in an axial direction of the spark plug, the ground electrode having a standing portion that stands distalward from a distal end of the housing;

a guide member configured to guide the flow of an air-fuel mixture in a combustion chamber of the internal combustion engine to the spark gap, the guide member protruding distalward from the distal end of the housing at a different circumferential position from the ground electrode; and an oblique surface formed at the distal end of the housing so as to be positioned in a circumferential direction of the spark plug between the guide member and the standing portion of the ground electrode, the oblique surface being oblique to the axial direction of the spark plug so that the radial distance between the oblique surface and the center electrode decreases in the distalward direction, and the oblique surface having a distal end positioned proximal ward from the distal end portion of the center electrode.

2. The spark plug as set forth in claim 1, wherein the oblique surface is formed to extend in the circumferential direction of the spark plug only within an angular range of less than or equal to 90° between the guide member and the standing portion of the ground electrode.

3. The spark plug as set forth in claim 2, wherein the oblique surface is formed to extend in the circumferential direction of the spark plug over the entire angular range.

4. The spark plug as set forth in claim 1, wherein the oblique surface is formed to extend in the circumferential direction of the spark plug over an entire angular range of less than or equal to 90° between the guide member and the standing portion of the ground electrode.

* * * * *